US006983569B1

(12) United States Patent
Rosenberg

(10) Patent No.: US 6,983,569 B1
(45) Date of Patent: Jan. 10, 2006

(54) MODULAR METAL WALL FRAMING SYSTEM

(76) Inventor: Zev Rosenberg, 275 Outremont Avenue, Outremont, P.O. (CA) H2V 3L9

( * ) Notice: Subject to any disclaimer, the term of this patent is extended or adjusted under 35 U.S.C. 154(b) by 0 days.

(21) Appl. No.: 09/370,736

(22) Filed: Aug. 9, 1999

(51) Int. Cl.
*E04H 1/00* (2006.01)

(52) U.S. Cl. ..... 52/241; 52/238.1

(58) Field of Classification Search ..... 52/241, 52/281, 481.1, 238.1, 656.1; 403/363, 403, 403/230

See application file for complete search history.

(56) References Cited

U.S. PATENT DOCUMENTS 1,993,792 A * 3/1935 Manske et al. ..... 52/241 X
2,235,761 A * 3/1941 Goldsmith ..... 52/241 X
2,298,104 A * 10/1942 Brunemann ..... 52/241 X
3,008,550 A * 11/1961 Miles et al. ..... 52/241 X
3,240,297 A * 3/1966 Desy ..... 403/230
3,244,290 A * 4/1966 Kaufman et al. ..... 211/189
3,680,271 A * 8/1972 Satchell ..... 52/241 X
3,720,995 A * 3/1973 Brown et al. ..... 228/170
3,845,601 A * 11/1974 Kostecky ..... 52/241 X
3,851,435 A * 12/1974 Roberts et al. ..... 403/230 X
4,459,790 A * 7/1984 Vermillion ..... 52/764
4,805,364 A * 2/1989 Smolik ..... 52/241
5,060,434 A * 10/1991 Allison ..... 52/241 X
5,212,926 A * 5/1993 Beasley ..... 52/238.1 X
5,274,973 A 1/1994 Liang
5,632,127 A * 5/1997 Agar et al. ..... 52/238.1 X
5,720,138 A * 2/1998 Johnson ..... 52/220.7

* cited by examiner

*Primary Examiner*—Janet M. Wilkens
(74) *Attorney, Agent, or Firm*—IP Strategies

(57) ABSTRACT

A wall frame is constructed with a pair of horizontally disposed metal channel members and a series of vertical studs spaced at predetermined intervals along the channel members. The studs are accurately located within the channel members by vertically upstanding tab stops which are struck out from the channel members. Pronged retainers are also struck outwardly from the channel members to fit through alignment slots formed in the studs. Weakened areas on the channel members can be crimped against the studs to lock the studs in place on the channel members. Horizontally disposed spacer bars are adapted to interconnect with a series of studs to strengthen and further align the studs and to provide a support surface against which dry wall or the like may be fastened.

13 Claims, 14 Drawing Sheets

MODULAR METAL WALL FRAMING SYSTEM

BACKGROUND OF THE INVENTION

1. Field of the Invention

The present invention relates in general to metal wall frames, and in particular to such frames which include channels and studs having integrally formed connectors, locators and retainers.

2. Description of Prior Developments

Framing systems have been developed using metal channels and studs in place of more conventional wood frames. Such systems have been adapted to construct various structures including residential and commercial buildings, and particularly the partitions of such buildings. Although these systems function adequately, they may be difficult to use and can take longer to assemble than conventional wood frames.

Because of these drawbacks, many builders have been reluctant to adopt prior metal framing systems. Moreover, installers have experienced difficulty in correctly installing prior metal framing systems. Installers also dislike the snipping and cutting of the metal frame members required in such systems, as the sharp metal edges can result in cut hands and torn clothes. For these reasons, wood frames are still the most commonly used frames for residential construction.

Although wood frames have been widely accepted by builders and installers, wood frames are not fireproof and wood tends to buckle, warp, split, shrink, and bend out of shape. Moreover, a wood stud is heavier and more awkward to work with than a metal stud, and is currently about twice the price of a metal stud.

Even with the drawbacks associated with wood frames, wood is still the material of choice of most builders, particularly since carpenters are familiar with wood frame construction and can nail wood frames together with a nail gun faster than they can screw a nail into a metal frame with a screw gun.

The following comparison of existing standard wood and conventional metal study applications may be of value in fully appreciating the advantages of the present invention.

Installation of a wall partition constructed of wooden studs, after upper and lower plates have been installed, requires the following steps for each stud:

1. Measure 16 inches on center or 24 inches on center from the previously installed stud and appropriately mark the measured distance on the upper and lower plate.
2. Measure the distance between upper and lower plates.
3. Measure the length of the stud to be installed to be equal to the measurement in the previous step and mark the stud where it is to be cut.
4. Cut the stud. The cut must be square, using a miter box, skill saw guide, etc.
5. Place the stud into position between the plates. Adjust the position of the stud by applying a level to assure that it is plumb, top to bottom, side to side and front to back.
6. Nail the bottom portion of the stud to the lower plate using two nails which can be nailed manually or with an automatic nailing gun.
7. Climb a ladder or scaffold and nail the top portion of the stud to the upper plate, again using two nails.
8. Usually framers will also install horizontal wood members to serve as braces and spacers between the studs. In such case there are the following additional steps:
   A. Measure and mark a piece of stud lumber to fit between the studs.
   B. Cut the piece of lumber square to form a brace.
   C. Nail two nails to one end of the brace and into one stud.
   D. Nail two nails into the other end of the brace and into the other stud.
9. When electricians run electrical cable through the studs, it is necessary for them to first bore a hole through each stud individually, i.e. those studs which will have cable going through them.

It can be seen that wood fame construction requires many individual time-consuming steps. Moreover, problems associated with wood studs include:

1. Wood is not fireproof.
2. Wood buckles, splits, shrinks and bends out of shape.
3. A wood stud is heavier and clumsier to work with than a corresponding metal stud.
4. A wood stud is currently about double the price of a metal stud, and with continuing depletion of natural reserves, prices for lumber will likely continue to rise.

Installation of a partition constructed of metal studs, after the upper and lower channels have been installed, requires the following steps for each stud:

1. Measure 16 inches on center or 24 inches on center from a previously installed stud and appropriately mark the measured distance on the upper and lower channels.
2. Measure the distance between upper and lower channels.
3. Measure the length of the stud to be installed to be equal to the measurement in the previous step and mark the stud where it is to be cut.
4. Cut the two side flanges of the stud with a pair of snippers, then bend the central backbone of the stud back and forth until it breaks off.
5. Place the stud into position between the channels where previously marked. Adjust the position of the stud by applying a level to assure that it is plumb, top to bottom and side to side.
6. Take two screw and individually mount each screw onto a screw gun and screw the bottom portion of the stud into the lower channel.
7. Climb a ladder, and again, take two screws and individually mount each onto a screw gun and screw the upper portion of the stud into the upper channel.
8. Many installers also place a horizontal brace and spacing member which runs through the apertures of several studs. In such case, there are the following additional steps:
   A. Run the bracing member through the apertures of several studs.
   B. Cut little tabs to connect and fasten each stud to its section of bracing member.
   C. Line up each stud to be properly aligned and plumb with each corresponding section of bracing member.
   D. Screw into a precut tab to connect the stud to the bracing member.

It can be seen that conventional metal frame construction requires many individual time consuming steps. Moreover, problems associated with conventional metal studs include:

1. There does not seem to be any installation time savings of metal over wood. In fact, one can argue that a wooden frame will go up faster than a metal frame because of the extra time required with metal in the process of cutting the stud to size and the fumbling required with screws as opposed to automatic nailing with a nailing gun and nail cartridges.

2. Since there do not appear to be real economies in time in the conventional installation of metal frames, many framing contractors prefer to use wood, the "old-fashioned" way.
3. When snipping and breaking off a piece of a metal stud, hands and clothing tend to get cut very easily.
4. Fumbling with the individual placement of a screw onto a screw gun and screwing into a conventional metal stud is cumbersome, annoying and more time-consuming than simply applying a cartridge-loaded nailing gun to wood.
5. Tunneling spacing members through holes in a series of studs and then dealing with the connection of the tabs between the studs and the spacing members is cumbersome, awkward and annoying.

However, metal stud installation does include the following benefits:

1. Metal is virtually fireproof.
2. Metal is lightweight and easier to work with than wood.
3. Metal studs remain intact and square and do not warp.
4. Metal studs are currently about half the price of wooden studs.
5. Metal studs have precut holes for electrical and other cable running.

Accordingly, a need exists for a framing system which is easy to understand, quick to assemble, which does not require extensive cutting or snipping and which is cost-effective as compared to current alternative methods.

A further need exists for such a system which is more economical to use than wood frame systems and which is readily accepted by architects, builders, installers and end users.

A further need exists for a framing system which provides accurate spacing between studs and which is available with modular interchangeable components.

Still a further need exists for a framing system which offers a complete and simple solution rather than a partial solution to the entire installation process.

SUMMARY OF THE INVENTION

The present invention has been developed to fulfill the needs noted above and therefore has as an object the provision of a metal framing system for supporting the walls, floors and ceilings of various building structures including residential and commercial buildings.

This invention provides a comprehensive and cost-effective solution to the construction industry in the creation and installation of wall/partition frames by facilitating a much simpler and speedier installation resulting in greatly reduced labor costs while at the same time maintaining quality control in the integrity and accuracy of the installation.

The construction industry whose workers are tradition and trade-oriented has been very slow to adopt any innovative methodologies or technologies. On the other hand, there is always a desire on the part of builders and consumers to reduce costs in building.

The only way to satisfy both ends of the spectrum is to present a solution which creates significant cost-savings while at the same time having certain key ingredients: simple, easy to learn, practical (makes life easier for the worker) and also provides a complete solution, rather than dribs and drabs.

This invention has the key ingredients to satisfy the worker and take away the worker's opposition to innovation. Those same ingredients have the effect of cutting costs for the builder. Time is money, and a speedy operation becomes a less expensive one.

Previous patents and innovations have in most instances offered a solution to only a small part of the process—rather than to the whole thing. This invention provides a complete solution. Importantly, the invention does not seek to "replace" steps in stud-wall building with a "better mouse trap". Instead it just eliminates some of the steps entirely for the tradesperson.

While saving money and streamlining operations, the invention maintains the integrity and accuracy of the installation. Studs must be perfectly square-plumb and on center for drywall installation.

Another object of the invention is the provision of a metal framing system which is easy to use, quick to assemble and does not require metal cutting during frame assembly.

Another object of the invention is the provision of a complete modular framing system which is simple in form, easy to learn and easy to use.

A further object of the invention is the provision of a metal wall framing system which eliminates some of the steps required to construct a conventional metal or wood frame, while providing a square, plumb and on-center metal frame for supporting drywall or other wall materials.

Yet another object of the invention is the provision of a metal framing system which is significantly faster and more economical to assemble than other wood and metal framing systems.

Still another object of the invention is the provision of a modular metal framing system which is easily used by an unskilled, lower-cost worker. The system is also intended for use by inexperienced do-it-yourself homeowners lacking the tools, knowledge and experience of a skilled professional framer.

A further object of the invention is the provision of a metal wall framing system which does not require supplemental hardware, requires no supplemental fasteners, nails, electric tools or other power tools, nor any measuring devices or cutting devices.

Still a further object of the invention is the provision of a modular metal framing system which includes a side spacer or bracer which optionally provides spacing and alignment of studs and serves as a larger surface for supporting drywall and into which metal screws can be more conveniently secured to hold the drywall to the frame.

These and other objects are met by the present invention which is directed to a modular metal framing system for constructing wall frames in virtually any type of building construction. The system is complete insofar as it requires virtually no additional hardware and can be readily used by unskilled labor. Metal wall frames constructed in accordance with the invention can be completed in a fraction of the time and at much lower cost than wood frames as well as other conventional metal frame systems.

In accordance with the invention, upper and lower metal channels are formed with a series of evenly spaced locators or stops which accurately locate a series of metal studs along the channels. The channels also include retainers or prongs located adjacent to the locators or stops for fitting within slots formed in the studs. The channels further include scored or notched areas located adjacent to the stops and prongs for allowing a portion of each channel side wall to be crimped inwardly to hold a stud in place on the channel.

In order to interconnect and mount a stud on a channel, the stud is simply moved along the channel with a sliding movement until the stud engages a stop. Just before the stud engages a stop, one or more locators or prongs slide into mating slots formed in the stud to hold and guide the stud into alignment with the stop. Notched or perforated portions in the channel sidewalls are then crimped inwardly to hold the stud in place within the channel. This provides a bracing system for spacing and leveling.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings:

FIG. 1(*a*) is a partial central longitudinal sectional view taken through a first embodiment of a retainer member;

FIG. 1(*b*) is a view similar to FIG. 1(*a*) showing an alternative embodiment of a retainer member;

FIG. 2(*a*) is a perspective view of the stud of FIG. 2 interconnected to the channel member of FIG. 1;

FIG. 4(*a*) is a view similar to FIG. 4 showing another embodiment of the invention;

FIG. 4(*b*) is a top plan view of FIG. 4(*a*);

FIG. 5(*a*) is a perspective view of an alternative embodiment of the extender of FIG. 5;

FIG. 8(*a*) is a top plan view of a portion of one of the spacer bars of FIG. 8;

In the various figures of the drawings, like reference characters designate like or similar parts.

DETAILED DESCRIPTION OF THE PREFERRED EMBODIMENTS

Figure 1:
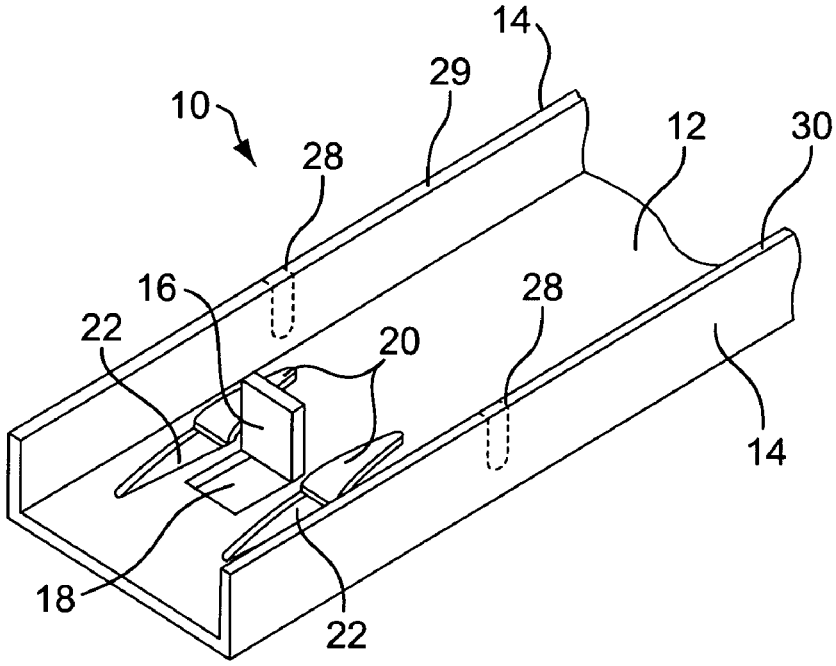
FIG. 1 is a perspective view of a portion of a metal wall framing channel member constructed in accordance with the invention.

The present invention will now be described in conjunction with the drawings, beginning with FIG. 1 which shows a channel member 10 constructed in accordance with the invention. Channel member 10 is adapted to be installed in a known manner on a lower support surface such as a floor. An identical second or upper channel member 10 is typically installed in a known manner on an overhead support surface such as a ceiling. The upper and lower channel members are aligned parallel with one another and typically aligned within a common vertical plane.

Channel member 10 includes a flat, longitudinally-extending central floor 12 and a pair of upstanding parallel side walls 14 which are bent upwardly at right angles from each side of floor 12. Channel member 10 is formed of a sheet metal material such as steel. A stud locator or stop member in the form of a tab 16 is struck or punched upwardly from the channel floor 12 leaving behind an open aperture 18 in floor 12.

Tab 16 may take virtually any shape such as the rectangular tab show in FIG. 1. Preferably, tab 16 is aligned vertically perpendicular to floor 12 and laterally or transversely perpendicular to each side wall 14. In this manner, tab 16 is "square" with both the floor and side walls of the channel member. A series of longitudinally-spaced tabs 16 is formed in channel member 10 with each tab located at regular intervals. Tabs 16 can be located at predetermined longitudinal spacings of, for example, 16 and/or 24 inches.

Figure 1A:
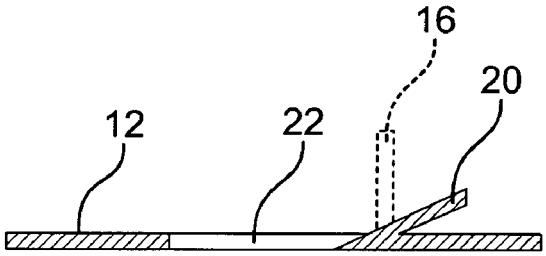

One or more retaining members 20 are also struck out or punched up from channel floor 12, leaving behind an open aperture 22 in floor 12. As shown in FIG. 1, a pair of tapered, pointed retainer members is laterally spaced on each side of tab 16. The retainer members may be ramped upwardly from floor 12 as seen in FIG. 1*a* or formed in an "L" shape as seen in FIG. 1*b*.

Figure 1B:
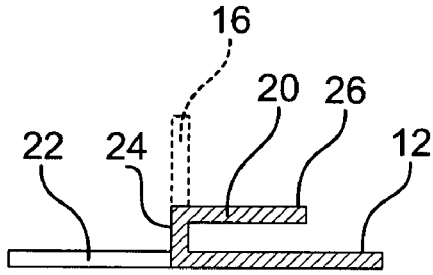

In FIG. 1*b*, the base 24 of retainer 20 is aligned perpendicularly upwardly from the floor 12 of channel member 10 and is located at the same longitudinal position on floor 12 as is tab 16. A leg 26 extends from base 24 on retainer 20 and is bent back over floor 12 and aligned parallel with floor 12.

As further seen in FIG. 1, a cut, notched, perforated or otherwise weakened crimp portion 28 is formed along one or both sidewalls 14. As shown, a pair of rectangular crimp portions 28 is formed along the top edge 29 of each side wall 14. Each crimp portion 28 is longitudinally spaced a predetermined distance away from each tab 16 to allow the crimp portions 28 to be squeezed or crimped inwardly toward each other in order to crimp a stud in place within channel member 10, as described more fully below.

Figure 2:
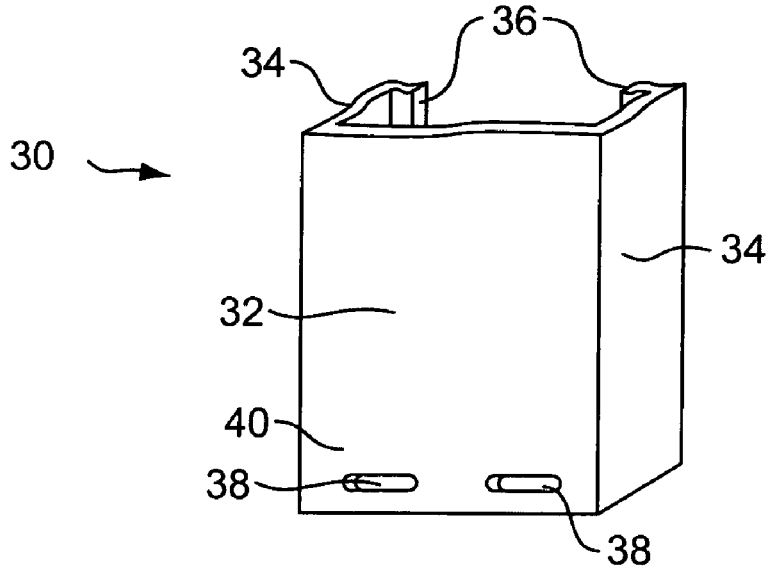
FIG. 2 is a perspective view of a bottom portion of a stud constructed in accordance with the invention.
Figure 2A:
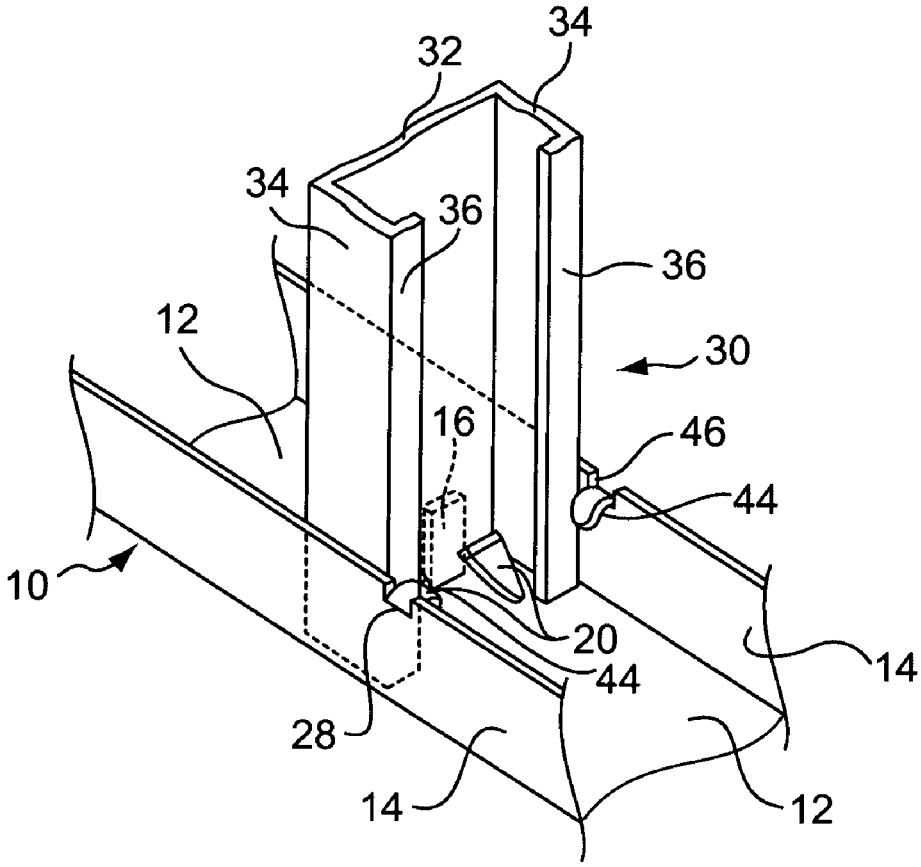

As seen in FIG. 2, a stud 30 is formed of a metal material, such as steel, in accordance with the invention. Stud 30 includes a central column portion 32 and a pair of parallel side walls 34 projecting perpendicularly from the column portion. An inturned lip 36 is formed on the outer end portion of each side wall 34. One or more alignment slots 38 are formed through the end portion 40 of stud 30 for receiving and interconnecting with one or more of the retainer members 20 on channel member 10.

As can be appreciated from a review of FIG. 2(*a*), the stud 30 is fitted between the side walls 14 of the channel member 10 with the bottom edge of the stud making sliding contact against the channel floor 12 and with the side walls 34 of the stud making sliding contact against the side walls 14 of the channel member. As the stud 30 approaches the tab 16 on the channel member 10, the tips of the retainer members 20 enter the alignment slots 38 in the stud 30.

When the stud is fully and properly butted flat against the tab 16, it is also fully seated against the retainer members 20. In the example of the retainer member 20 of FIG. 3, the rear face of column portion 32 abuts the tab 16 as well as the base 24 of each retainer member 20. Once this three position contact has been achieved, the stud 30 is properly and fully aligned and seated within the channel member 10.

At this point, the crimp portions 28 are bent inwardly from the side walls 14 of channel member 10 to form locking members 44. An open notch 46 is thus formed in the top edge 29 of each side wall 14. The locking members 44 can be closely spaced from the lips 36 on stud 30 or in contact with lips 36.

Figure 3:
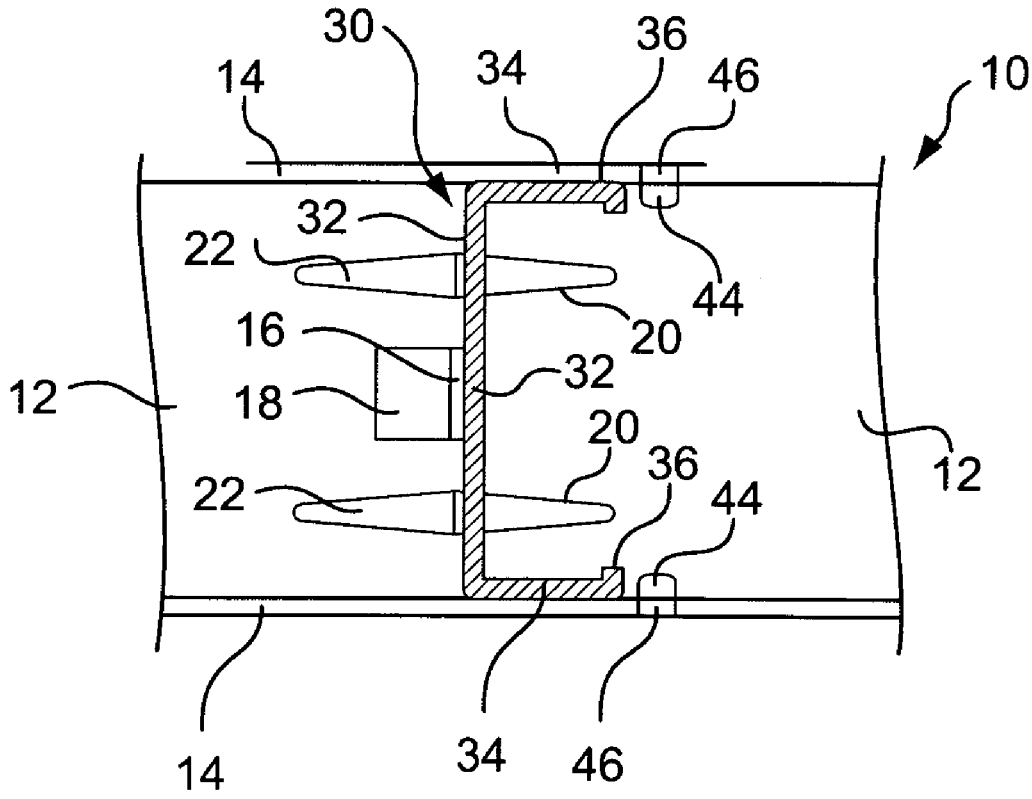
FIG. 3 is a top plan view of FIG. 2(*a*)

The general spacing of the interconnected channel member 10 and stud 30 is shown in FIG. 3 wherein the stud is held in position vertically by the retainer members 20, held laterally by contact with side walls 14 and locked longitudinally by abutment in one direction with tab 16 and in the other by abutment with locking members 44.

Figure 4:
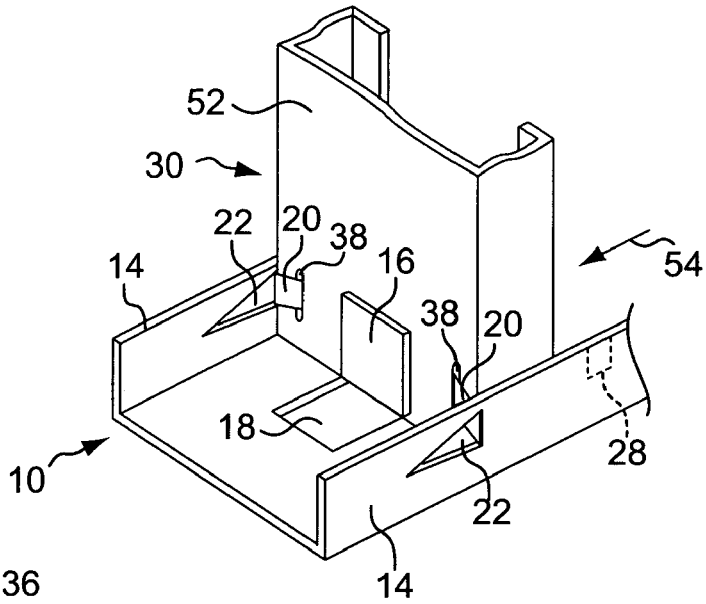
FIG. 4 is a perspective view of an alternative embodiment of the stud of FIG. 2 connected to an alternative embodiment of the channel of FIG. 1.
Figure 4A:
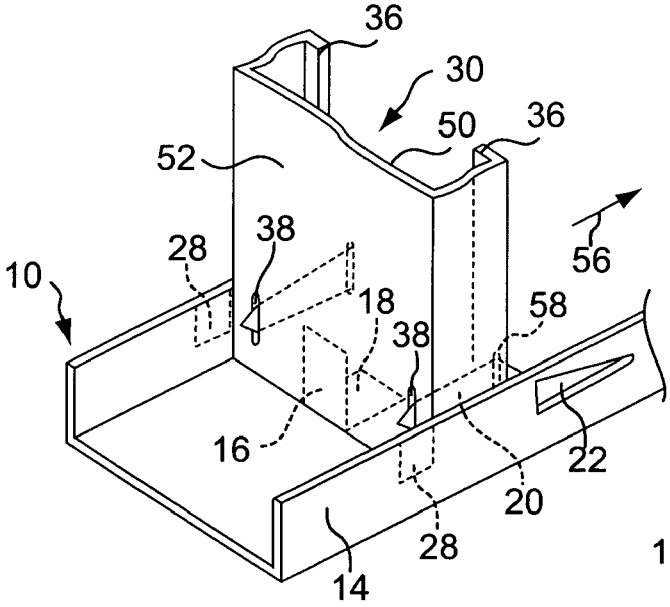
Figure 4B:
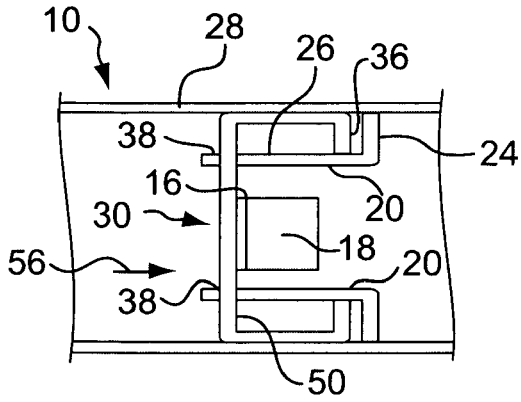

A variation of this positioning, locating, aligning and locking stud and channel framing system is shown in FIG. 4 wherein the retainer members 20 are struck out from the side walls 14 of the channel member 10 and extend inwardly over the floor 12 of the channel member. The stud 30 is modified to locate the elongated alignment slots 38 in a vertical orientation in order to receive and mate with the retainer members 20. The tab 16 is arranged as in the prior example, and crimp portions 28 are formed in side walls 14 as in the prior example.

A further variation of the invention is shown in FIGS. 4(*a*) and 4(*b*) wherein the retainer members 20 enter vertical slots 38 through the inside surface 50 of channel member 10 rather than through the outside or back side 52 as shown in FIG. 4. In the example of FIG. 4, the back side 52 is slid into and against the retainer members 20 in the direction of arrow 54. In the example of FIGS. 4(*a*) and 4(*b*), the inside surface 50 is slid into and against the retainer members 20 in the direction of arrow 56.

In the example of FIG. 4(*a*), a cut-out portion 58 can be formed in each lip 36 for providing clearance for the passage of retainer members 20 through the lips 36. Alternatively, as shown in FIG. 4(*b*), the base 24 of the retainer members can be dimensioned to extend into the channel member to provide clearance of leg 26 over lip 36. Crimp portions 28 are formed adjacent to lips 36 in FIG. 4 and adjacent to back surface 52 and to slots 38 in FIGS. 4(*a*) and 4(*b*).

In each of the prior examples, a pair of identical channel members 10 is aligned with one channel member directly above another. One channel member may be attached by fasteners to a floor and the other similarly attached to a ceiling. The tabs 16 on each channel member are vertically aligned one directly over the other and the channel members are carefully plumbed longitudinally parallel with one another as well.

The aligned channel members provide for the accurate vertically plumbed alignment of the studs when the studs are pushed against a pair of aligned tabs 16; one tab being on the upper channel member and one on the lower channel member. In this case, the alignment slots 38 on each opposite end of the stud 30 are identical so that both ends of the studs are aligned by sliding the studs against a pair of stops or tabs 16 and interengaging the slots 38 with retainer members 20 on each channel member 10. Crimp portions 28 are then bent inwardly as described above.

Figure 5:
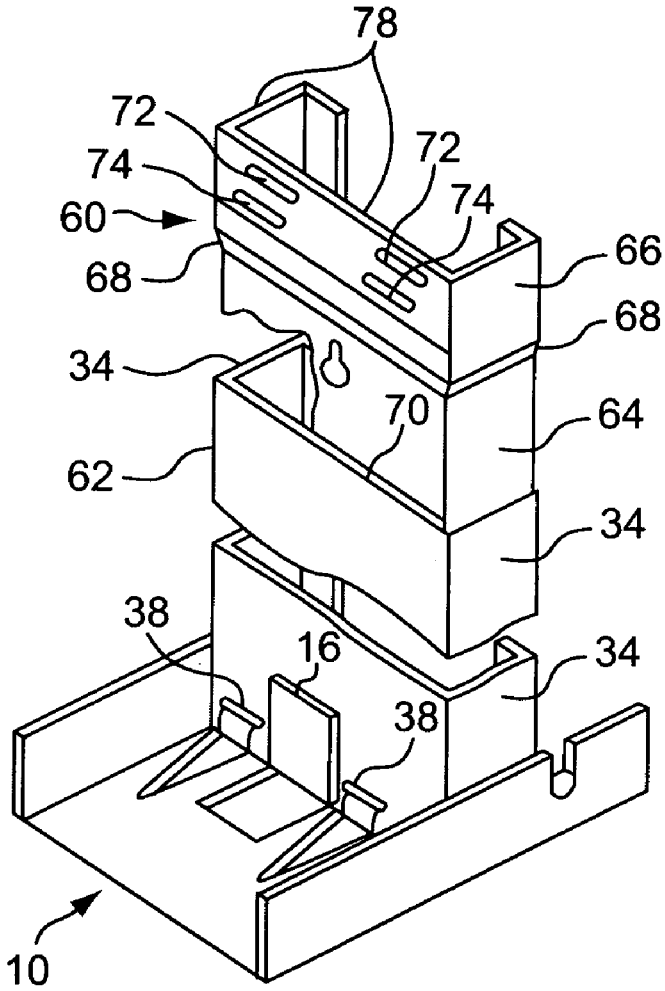
FIG. 5 is a schematic perspective view of the stud and channel of FIG. 2(*a*) provided with a vertically sliding extender.
Figure 5A:
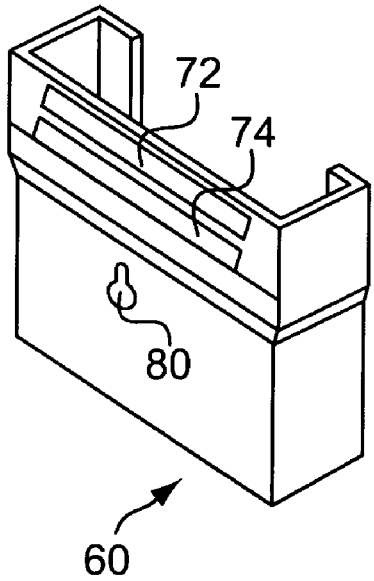

A further embodiment of the invention is shown in FIG. 5 wherein the lower end of the stud 30 is the same as shown in any of the prior examples and in this case, as shown in FIG. 2. The channel member 10 is shown as in FIG. 1 to match the slot pattern on the stud. What is different about the stud 30 in FIG. 5 is the addition of an extender member 60 which is telescopically held within and between the side walls 34 of the top portion 62 of stud 30.

Rather than secure the upper or top portion 62 of stud 30 directly to an overhead channel member 10, the extender 60 is vertically adjusted by sliding within the top portion 62 to engage the tabs 16 and retainer members 20 on the channel member 10. The side walls 64 on extender 60 may be slightly inwardly tapered toward one another to form a snug sliding friction fit against the side walls 34 of top portion 62. This prevents the extender from having a loose slack fit within the stud 30.

The upper portion 66 of the extender 60 may be transversely or laterally enlarged along outwardly tapered portions 68 to prevent the extender 60 from sliding completely into the stud 30 by interfering with or abutting against the top edge 70 of stud 30. As further seen in FIG. 5, the extender 60 is formed with a pair of upper alignment slots 72 and a pair of lower alignment slots 74.

Normally, the lower alignment slits 74 are engaged with retainer members 20 on an upper channel member 10 attached to a ceiling. The retainer members 20 are thus spaced below the ceiling on which the upper channel member is fastened and spaced below the floor 12 of the upper channel member 10. With this arrangement, the top edge 78 of the extender 60 fits snugly against the floor 12 of the upper channel member. When the upper slots 72 are engaged with the retainer members 20, the top edge 78 of the extender 60 is spaced a small distance below the floor 12 of the upper channel member. This spacing accommodates settling of the ceiling and floors of the building structure and/or allows for additional loading which can compress and lower a ceiling.

When a stud 30 is attached directly to an upper channel member without an extender 60, it is suitable for use in load bearing walls, providing the gauge of the metal stud meets the strength requirements for a load bearing partition. However, when the extender 60 is used, it is loosely telescopically positioned within the stud and as such is not suitable for use in load bearing walls.

As seen in FIG. 5(*a*), the pairs of upper and lower alignment slits 72, 74 of FIG. 5 may each be replaced with a single elongated slot 72, 74. This single slot concept can also be used in place of the alignment slots 38 formed on the stud 30. In these cases, the retainer members 20 can be replaced with a single wider retainer which extends across substantially the entire width of each single elongated alignment slot.

Figure 6:
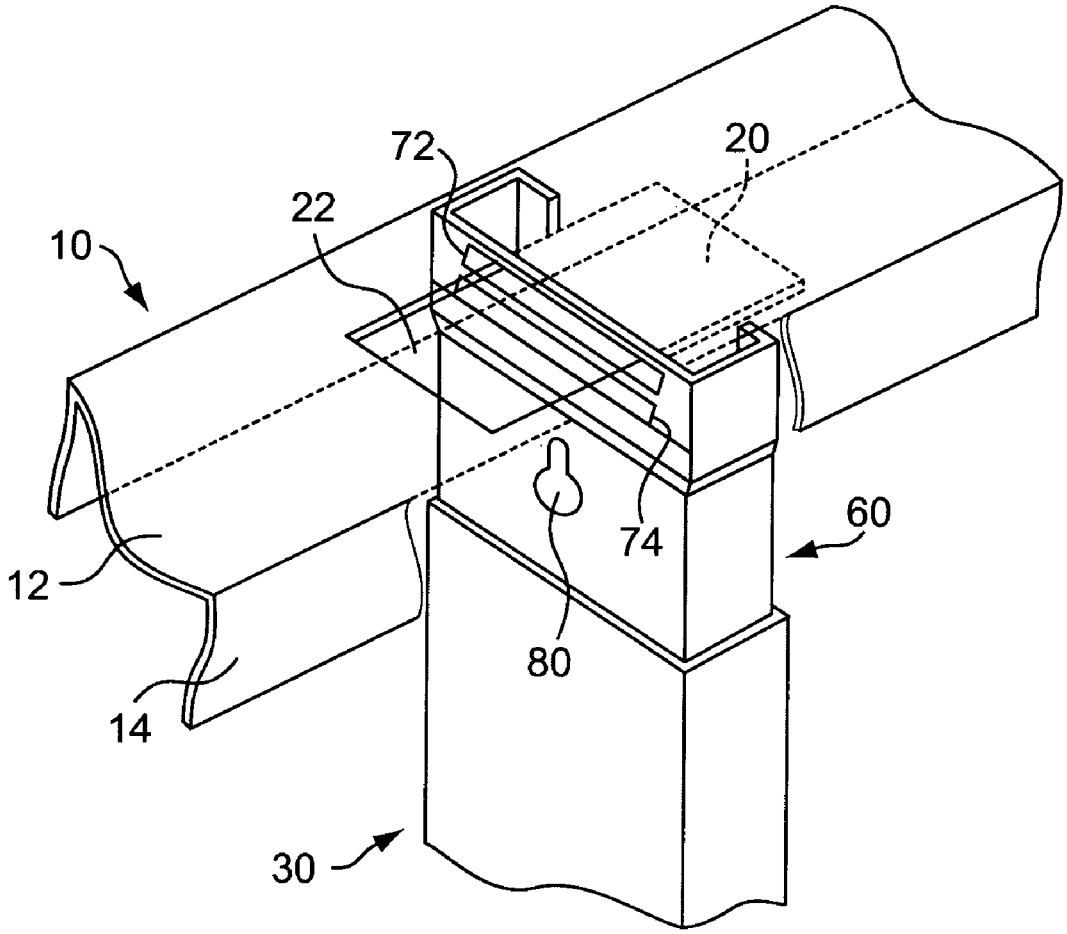
FIG. 6 is a partial view of the extender of FIG. 5(*a*) interconnected to an alternative embodiment of an upper channel member.

The extender 60 of FIG. 5(*a*) is shown in FIG. 6 mounted to an upper channel member 10 having a large single retainer member struck out from the floor 12 of the channel member and inserted through the upper alignment slot 72 on extender 60. The extender 60 is formed with a push hole 80 to allow an installer to push the extender 60 upwardly with a rod or the like engaged within hole 80 while pushing the lower end of stud 30 against a tab 16 as shown in FIG. 5 and inserting the retainer members 20 through the stud slots 38. This can be done without the use of a ladder, with an installer standing on the floor.

Figure 7:
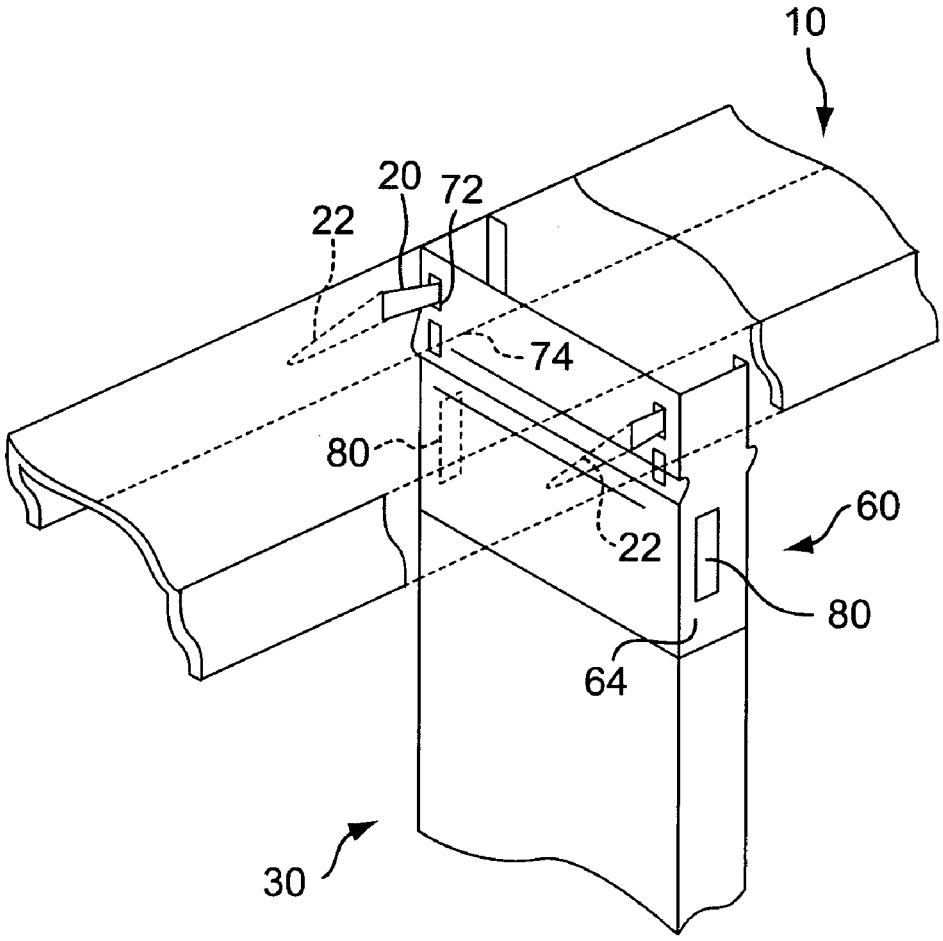
FIG. 7 is a view similar to FIG. 6 showing another embodiment of an extender connected to an upper channel member similar to that shown in FIG. 4.

A variation of the horizontally or transversely elongated alignment slots 72, 74 of FIG. 5 is shown in FIG. 7 wherein the alignment slots 72, 74 are elongated vertically and the mating retainer members 20 are formed as in FIG. 4. Push holes 80 can be alternatively formed in the side walls 64 of extender 60.

In each of the embodiments discussed above, the upper and lower portions of each stud 30 are secured in place between the upper and lower channels 10 and held in place by stops such as tabs 16 which are accurately positioned on, for example, 16 inch or 24 inch spacings. An alternative embodiment of this arrangement is to secure the bottom portion of each stud 30 as described in any of the examples above, but to allow the upper portion of each stud to slide longitudinally within the upper channel member without being locked in place.

This can be achieved by eliminating the tabs 16 from the upper channel member 10. One or more "L" shaped retainer members 20 as shown in FIG. 1(*b*) serve as the stop against which the stud is positioned. The base 24 of retainer member 20 acts as a stop like tab 16, and the leg 26 of retainer member 20 acts as a longitudinally-extending guide over which the top portion of the stud 30 or extender 60 freely slides.

In this embodiment, the upper channel member 10 need not be accurately aligned horizontally from wall to wall with the lower channel member 10. The lower channel member 10 is spaced and positioned where desired and the upper channel member 10 is simply approximately located above the lower channel member. Although the upper and lower channel members are aligned vertically in a common plane, they are not necessarily spaced and aligned accurately on 16 inch or 24 inch centers with one another. This allows for wall variations which may be wider on top than at the bottom or vice versa.

In this case, the lower ends of the studs 30 are secured within a channel member 10 as discussed in connection with the previous embodiments. The upper ends of the studs 30 (or extenders 60) are simply slid onto the retainer members 20 and left to freely slide or "float" along the length of retainer legs 26. Accurate spacing of the studs 30 can still be achieved, however, by the use of one or more central spacer or bracer bars 84 as shown in FIG. 8.

Figure 8:
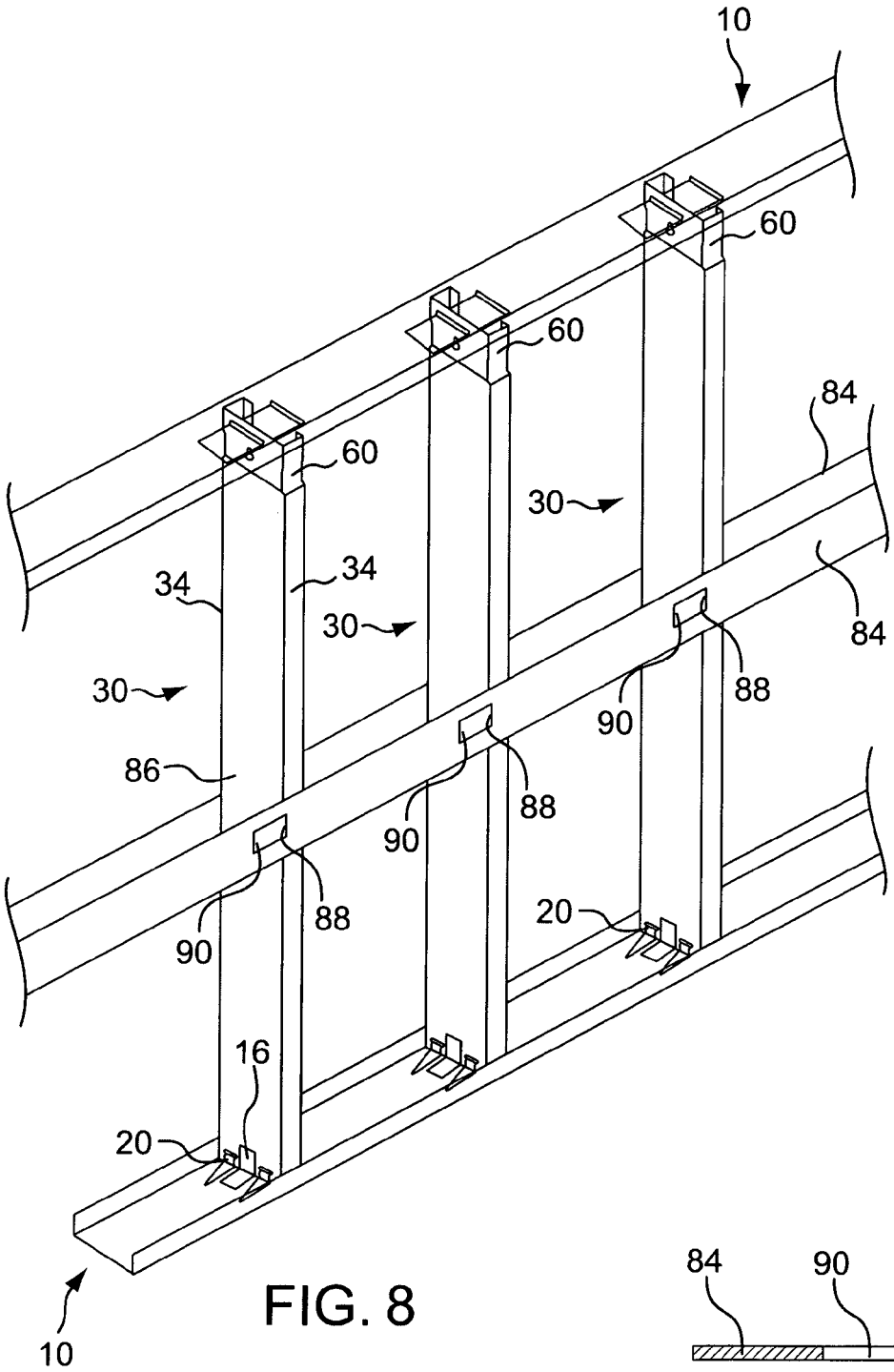
FIG. 8 is a partial perspective view of a wall frame constructed in accordance with the invention and showing the use of a pair of horizontally disposed space bars.
Figure 8A:
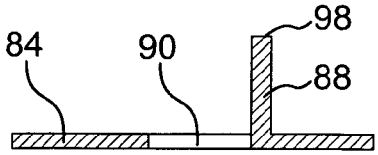

In FIG. 8, the upper ends of the studs 30 are provided with extenders 60 which are free to slide longitudinally or "float" along retainer members 20 as noted above. The lower end of each stud 30 is positioned and locked in place as in FIG. 2(*a*). After two or three of the studs 30 are so arranged and placed in the upper and lower channel members 10, one or more spacer bars 84 are connected to the central or middle portion 86 of each stud 30.

As seen in FIGS. 8 and 8(*a*), each spacer bar 84 has a series of accurately spaced tongue members 88 struck out of the sheet metal spacer material leaving behind an opening 90. The tongue members are spaced apart, for example, on 16 inch and/or 24 inch centers, and are dimensioned to fit or snap within receiving members of sockets formed on the studs 30.

Figure 9:
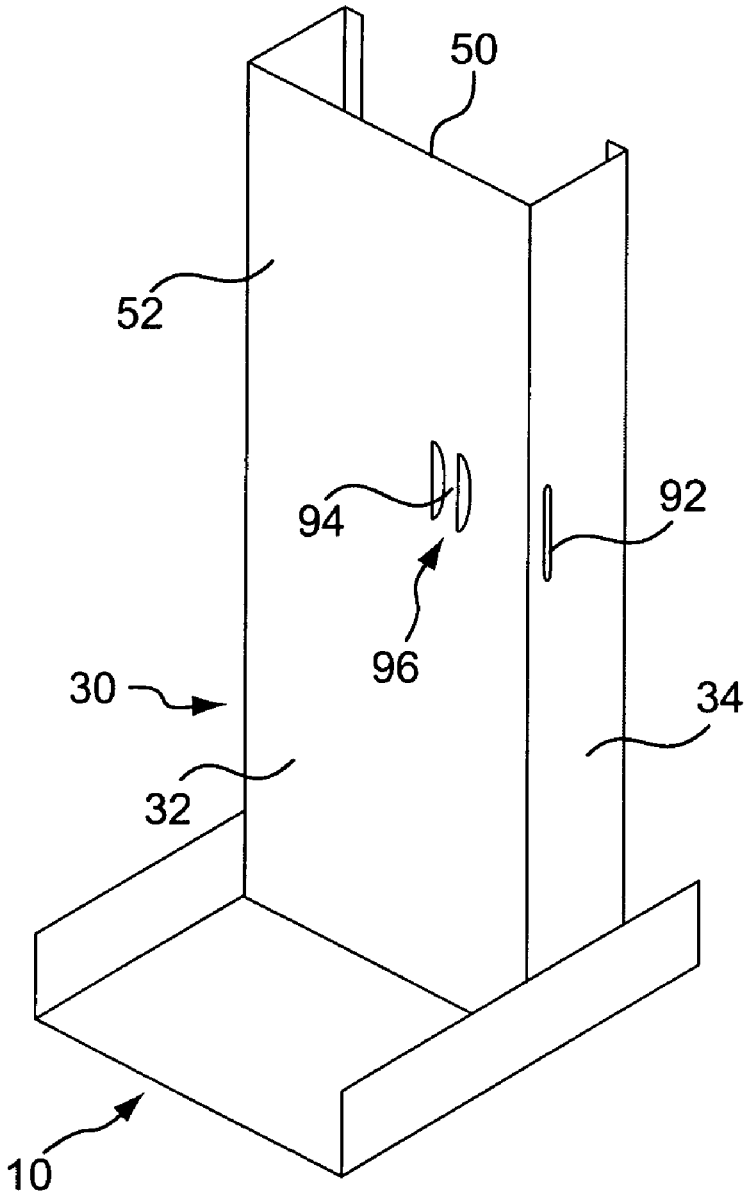
FIG. 9 is a partial perspective view of another embodiment of a stud constructed in accordance with the invention and formed with a socket struck out from the central column of the stud.

One example of such receiving members is shown in FIG. 9 wherein a vertically, elongated receiving slot 92 is punched through the side wall 34 of stud 30 directly and immediately adjacent to the inner surface 50 of channel member 10. Arched shaped bands or loops 94 are punched through the central column portion 32 of stud 30 from the outer surface or back side 52 toward the inner surface 50 to form a socket 96 which receives the free end 98 of tongue members 88.

Socket 96 is dimensioned to receive each tongue member 88 with a tight locking fit or a snap fit. While the tongue members in FIGS. 8 and 8(*a*) are shown with a rectangular shape, they can also be formed with a triangular shape similar to the retainer members 20 shown in FIG. 1. Although only one spacer bar 84 is required, two can be used as shown in FIG. 8 attached to opposite side walls 34 of each stud 30.

Figure 10:
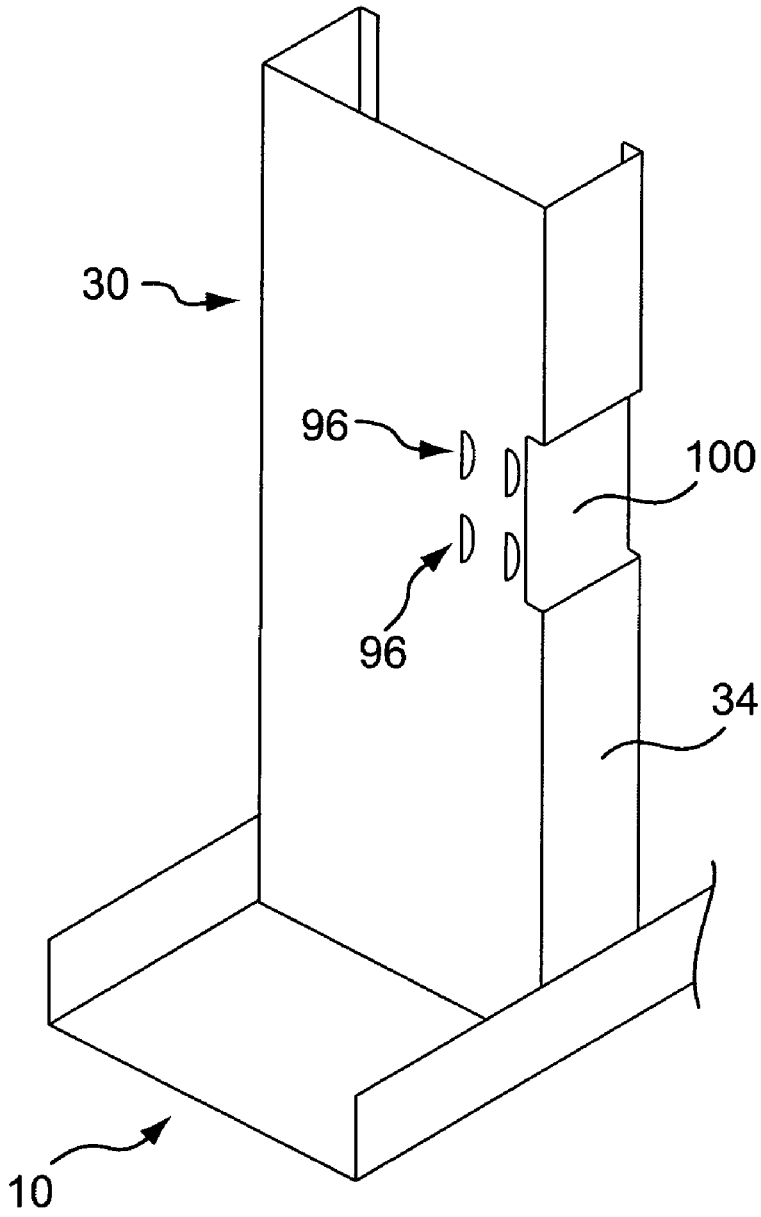
FIG. 10 is a view similar to FIG. 9 showing another embodiment of socket construction and a stud having an indented portion formed along one or both side walls.

A further variation of the spacer bar assembly is shown in FIG. 10 wherein a rectangular indented or recessed portion 100 is formed in the side wall 34 of stud 30 adjacent to a pair of sockets 96. The recessed portion 100 receives the flat spacer bar 84 with a flush fit so that the spacer bar does not extend outwardly from the plane of side wall 34, or extends only slightly outwardly. In either case, the spacer bar 84 will not interfere with the placement of drywall.

Figure 11:
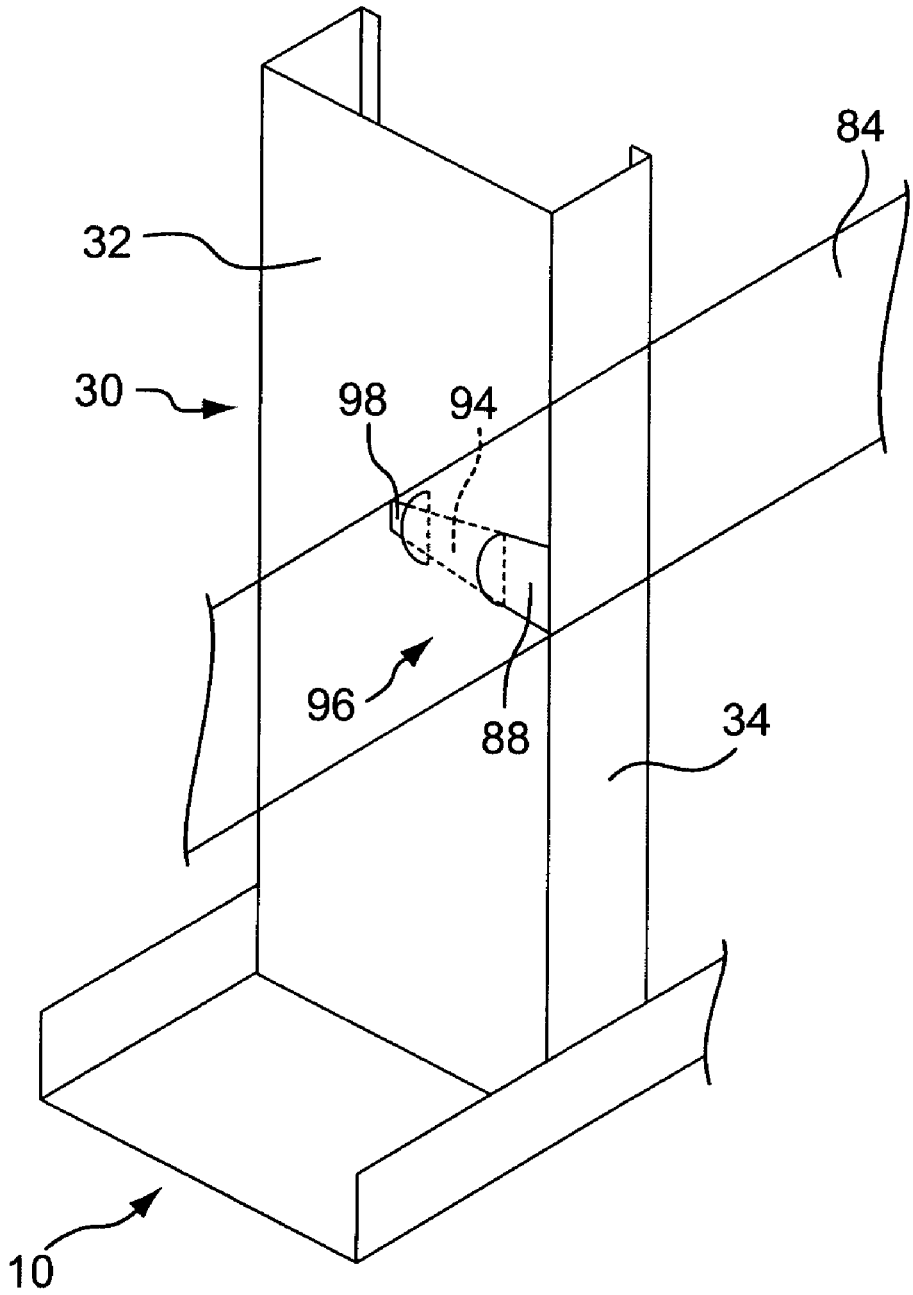
FIG. 11 is a schematic view similar to FIG. 9 showing a spacer bar interconnected to a stud constructed with an alternative embodiment of the socket of FIG. 9.

A variation of the socket 96 of FIG. 9 is shown in FIG. 11 wherein one or more loops or bands 94 are stuck out from the central column portion 32 from the inner face 50 of stud 30 toward its outer face 52. In this manner, the bands 94 project from outer face 52 and therefore the receiving slot 92 of FIG. 9 is not required.

Figure 12:
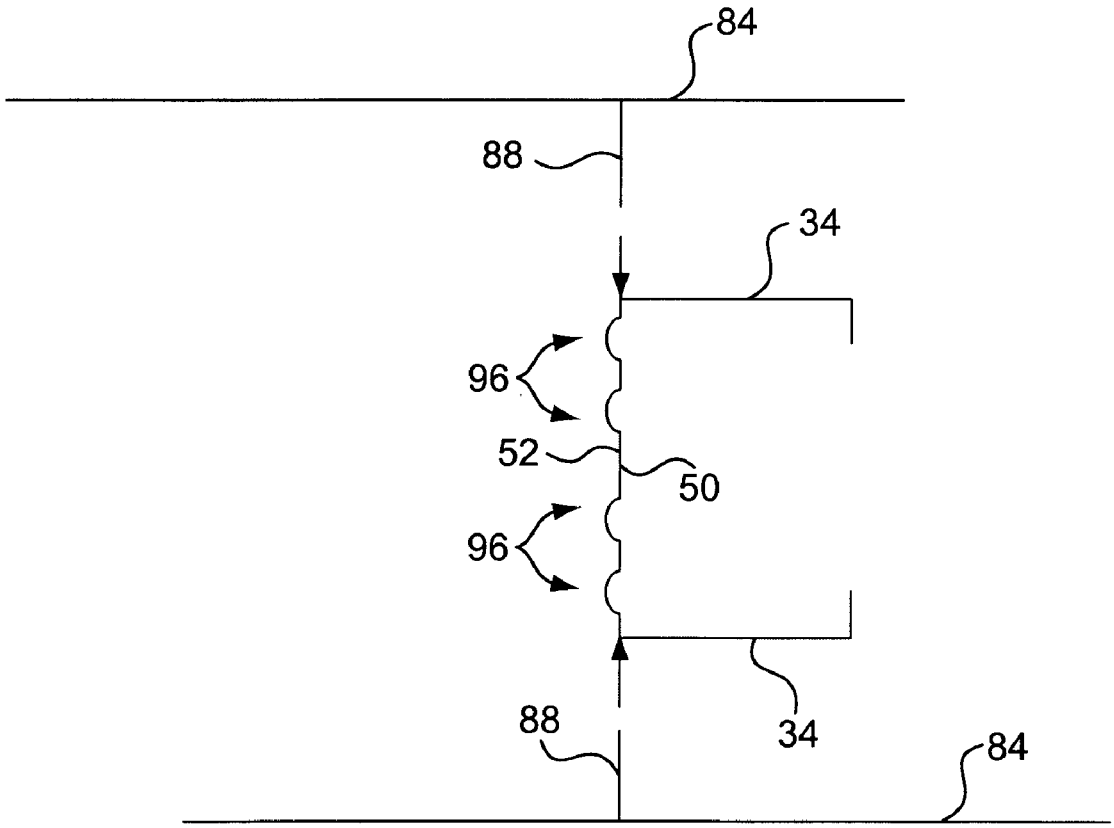
FIG. 12 is a partial schematic top plan view of a pair of spacer bars aligned with a channel member having sockets for receiving each spacer.
Figure 13:
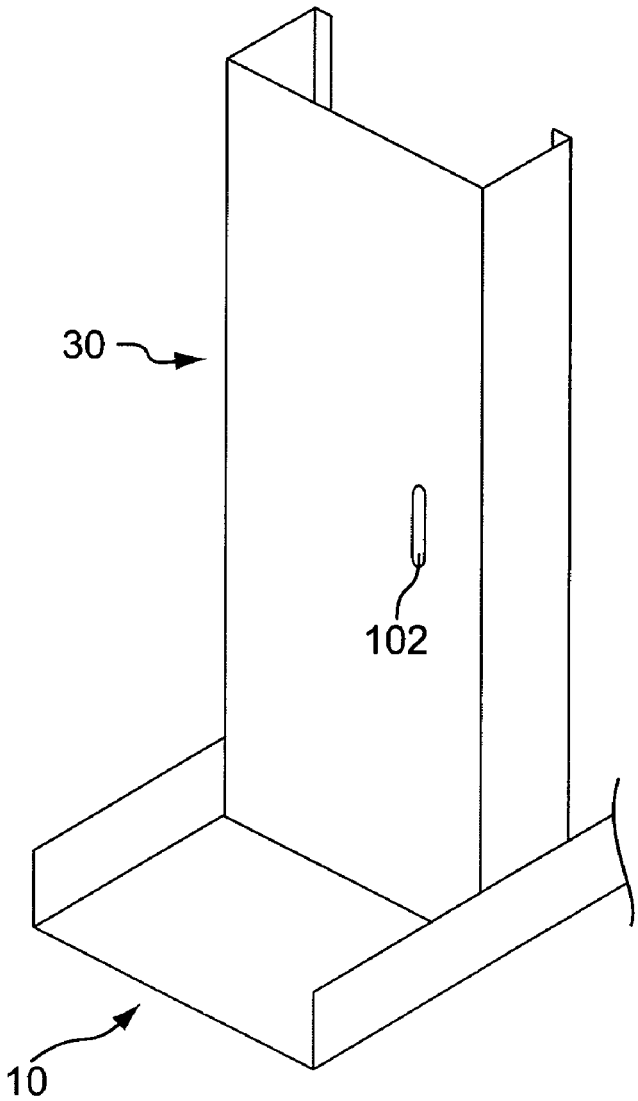
FIG. 13 is a partial perspective view of a spacer bar formed with an alternative embodiment of a socket.
Figure 14:
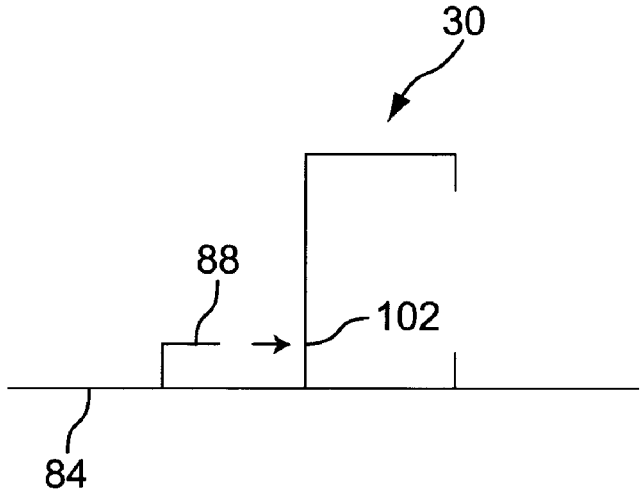
FIG. 14 is a partial schematic top plan view of a spacer bar provided with an alternative tongue configuration for insertion within the socket of FIG. 13.

In FIG. 12, a pair of spacers 84 is shown aligned for insertion within two pairs of sockets 96 formed on the outer or backside 52 of column portion 32. In FIGS. 13 and 14 the spacer bar 84 is formed with an L-shaped tongue member 88 and the stud 30 is formed with a single elongated slot 102 for receiving the tongue member 88.

Figure 15:
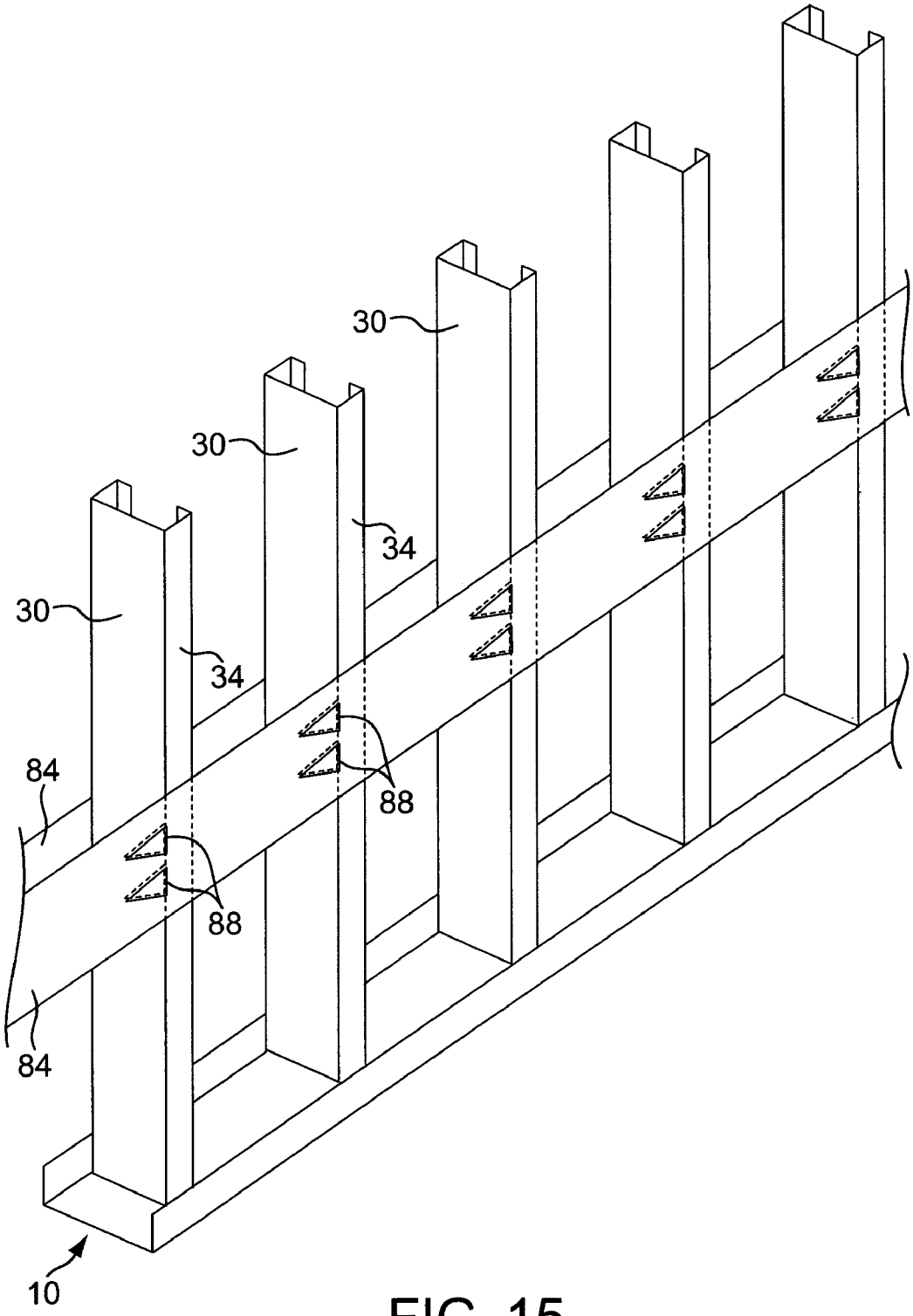
FIG. 15 is a partial perspective view of a series of studs spaced apart and mutually braced by an alternative embodiment of spacer bar and an alternative embodiment of sockets formed on the studs as shown in FIG. 10.

As seen in FIG. 15, two triangular tongue members 88 are struck out perpendicularly from spacer bar 84 to enter a pair of receiving slots formed in sidewalls 34 in the same manner as receiving slots 92 shown in FIG. 9.

There has been disclosed heretofore the best embodiment of the invention presently contemplated. However, it is to be understood that the various changes and modifications may be made thereto without departing from the spirit of the invention.

What is claimed is:

1. A metal stud assembly adapted for constructing a metal wall frame, comprising:

a stud;

a channel member; and a spacer bar;

wherein the channel member includes a retainer; and wherein the stud includes a longitudinally-extending central column portion having a pair of opposite end portions, a pair of side walls formed on opposite sides of said central column portion, a pair of elongated alignment slots that receive the retainer, formed in one of said end portions of said central column portion, and an indented portion formed in said stud that receives the spacer bar.

2. The metal stud assembly of claim 1, further comprising an extender longitudinally slidably mounted within said stud.

3. The metal stud assembly of claim 2, wherein said extender is formed with a push hole for pushing and sliding said extender within said stud.

4. A metal wall frame system, comprising:

a metal channel member having a floor portion and a pair of side walls upstanding from said floor portion;

a series of stops formed at predetermined intervals along said channel member;

a series of retainer members formed at predetermined intervals along said channel member;

a series of metal studs interconnected to said channel member, wherein each said stud has at least one alignment slot formed therein, receives a respective one of said retainer members, and is butted against a respective one of said stops; and a series of spacer bars, each said spacer bar interconnecting adjacent ones of said studs;

wherein each said stud comprises a side wall having a recessed portion receiving a respective one of said spacer bars.

5. A metal wall frame system, comprising:

a metal channel member having a floor portion and a pair of side walls upstanding from said floor portion;

a series of stops formed at predetermined intervals along said channel member;

a series of retainer members formed at predetermined intervals along said channel member;

a series of metal studs interconnected to said channel member, wherein each said stud has at least one alignment slot formed therein, receives a respective one of said retainer members, and is butted against a respective one of said stops; and a series of spacer bars, each said spacer bar interconnecting adjacent ones of said studs;

wherein said stops are formed as upstanding tabs struck from said channel member; and wherein each said stud comprises a side wall having a recessed portion receiving a respective one of said spacer bars.

6. The system of claim 5, further comprising a series of longitudinally spaced crimp portions crimped inwardly from said side walls and locking said studs on said channel member.

7. The system of claim 5, wherein each of said studs comprises a socket and wherein each said spacer bar comprises a series of projections respectively extending into each of said sockets.

8. A metal wall frame system, comprising:

a metal channel member having a floor portion and a pair of side walls upstanding from said floor portion;

a series of stops formed at predetermined intervals along said channel member;

a series of retainer members formed at predetermined intervals along said channel member;

a series of metal studs interconnected to said channel member, wherein each said stud has at least one alignment slot formed therein, receives a respective one of said retainer members, and is butted against a respective one of said stops;

a series of longitudinally spaced crimp portions crimped inwardly from said side walls and locking said studs on said channel member; and a series of spacer bars, each said spacer bar interconnecting adjacent ones of said studs;

wherein each said stud comprises a side wall having a recessed portion receiving a respective one of said spacer bars.

9. The system of claim 8, wherein each of said studs comprises a socket and wherein each said spacer bar comprises a series of projections respectively extending into each of said sockets.

10. A metal wall frame system, comprising:

a metal channel member having a floor portion and a pair of side walls upstanding from said floor portion;

a series of stops formed at predetermined intervals along said channel member;

a series of retainer members formed at predetermined intervals along said channel member;

a series of metal studs interconnected to said channel member, wherein each said stud has at least one alignment slot formed therein, receives a respective one of said retainer members, and is butted against a respective one of said stops; and a series of spacer bars, each said spacer bar interconnecting adjacent ones of said studs;

wherein each said stud comprises a socket and wherein each said spacer bar comprises a series of projections respectively extending into each of said sockets; and wherein each said stud comprises a side wall having a recessed portion receiving a respective one of said spacer bars.

11. A metal stud assembly adapted for constructing a metal wall frame, comprising:

a stud;

a channel member;

an extender longitudinally slidably mounted within said stud; and a spacer bar;

wherein the channel member includes a retainer; and wherein the stud includes a longitudinally-extending central column portion having a pair of opposite end portions;

a pair of side walls formed on opposite sides of said central column portion;

an alignment slot that receives the retainer, formed in one of said end portions of said central column portion; and an indented portion formed in at least one of said side walls that receives the spacer bar.

12. The stud assembly of claim 11, wherein said alignment slot comprises a pair of elongated alignment slots.

13. The metal stud assembly of claim 11, wherein said extender is formed with a push hole for pushing and sliding said extender within said stud.

* * * * *